US009328561B2

(12) United States Patent
Trinh et al.

(10) Patent No.: US 9,328,561 B2
(45) Date of Patent: May 3, 2016

(54) DRILL BITS WITH SENSORS FOR FORMATION EVALUATION

(75) Inventors: Tu Tien Trinh, Houston, TX (US); Eric Sullivan, Houston, TX (US); Xiaomin C. Cheng, The Woodlands, TX (US); Gregory C. Prevost, Spring, TX (US); Feyzi Inanc, Spring, TX (US); Yi Liu, Houston, TX (US); Jason R. Habernal, Magnolia, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 938 days.

(21) Appl. No.: 13/554,641

(22) Filed: Jul. 20, 2012

(65) Prior Publication Data

US 2013/0020130 A1 Jan. 24, 2013

Related U.S. Application Data

(60) Provisional application No. 61/509,699, filed on Jul. 20, 2011.

(51) Int. Cl.
*E21B 10/00* (2006.01)

(52) U.S. Cl.
CPC ..... *E21B 10/00* (2013.01); *Y10T 29/49771* (2015.01)

(58) Field of Classification Search
CPC ..... E21B 10/00; E21B 10/26; E21B 47/00; B23P 15/32; B23Q 17/0952; B23Q 17/0966; B23Q 17/0999
USPC ..... 175/40; 76/108.1–108.6
See application file for complete search history.

(56) References Cited

U.S. PATENT DOCUMENTS

2010/0038136 A1* 2/2010 Trinh et al. ..... 175/40
2010/0193254 A1* 8/2010 Lind et al. ..... 175/393
2011/0253446 A1* 10/2011 Trinh et al. ..... 175/45

OTHER PUBLICATIONS

Cheatham, C., & Nahm, J. (1990). Bit Balling in Water-Reactive Shale During Full-Scale Drilling Rate Tests.*

* cited by examiner

*Primary Examiner* — Cathleen Hutchins
*Assistant Examiner* — Tara Schimpf
(74) *Attorney, Agent, or Firm* — Cantor Colburn LLP

(57) ABSTRACT

In one aspect, a method of making a drill bit is disclosed that includes selecting a drill bit configuration, obtaining a stress map for the drill bit configuration relating to a drilling operation, performing a mechanical test with an actual drill bit having the selected configuration, and selecting a location on a surface of the drill bit for installing a sensor thereat based on a location of low stress from the stress map and results of the mechanical test, and placing a sensor at the selected location.

23 Claims, 7 Drawing Sheets
(2 of 7 Drawing Sheet(s) Filed in Color)

DRILL BITS WITH SENSORS FOR FORMATION EVALUATION

CROSS-REFERENCE TO RELATED APPLICATIONS

This application takes priority from U.S. Provisional Application Ser. No. 61/509,699, filed on Jul. 20, 2011, which is incorporated herein in its entirety by reference.

BACKGROUND INFORMATION

1. Field of the Disclosure

This disclosure relates generally to drill bits that include sensors for providing measurements relating to detection of gamma rays from formations.

2. Brief Description of the Related Art

Oil wells (wellbores) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations, behavior of the BHA and formation surrounding the wellbore being drilled (formation parameters). A variety of sensors, including gamma ray detectors, generally referred to as logging-while-drilling (LWD) sensors or measurements-while-drilling (MWD) sensors, are disposed in the BHA for estimating properties of the formation. Such sensors, however, are placed several feet from the drill bit and generally cannot provide formation information proximate the drill bit as the drill bit is cutting the formation. But certain type of sensors placed in the drill bit can provide useful information about the formation proximate the drill bit at substantially the same time as the drill bit is cutting the formation. It is desirable to place certain sensors, such as gamma ray sensors, at the face of the drill bits. Sensors placed at the face of the drill can reduce mechanical strength of the drill and thus it is desirable to locate such sensors at bit face locations that are less prone to reducing the mechanical integrity of the drill bit.

The disclosure herein provides a method of selecting locations for sensors on the drill bit and drill bits that include sensors at such selected locations.

SUMMARY

In one aspect, a method of providing a drill bit is disclosed, In one embodiment, the method includes: selecting a drill bit configuration, obtaining a stress map for the drill bit configuration relating to drilling of a wellbore by a drill bit of the selected configuration, performing one of a fluid flow test, rubbing test and balling test on a drill bit of the selected configuration, and selecting at least one location on the face of the drill bit for installing a sensor at such location based on a location of low stress from the stress map and results at least one of the rubbing test, fluid flow test and the balling test.

In another aspect, a drill bit is disclosed that in one embodiment includes: a sensor at a selected location on a drill bit surface, the drill bit having a selected configuration, wherein the selected location has been obtained by: obtaining a stress map of a drill bit of the selected configuration relating to drilling by a drill bit of the selected configuration into a solid material; performing one of a fluid flow test, rubbing test and balling test on an actual drill bit having the selected configuration; and determining the selected location on the drill bit surface based on the stress map and at least one of the rubbing test, fluid flow test, and the balling test.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The patent or application file contains at least one drawing executed in color. Copies of this patent or patent application publication with color drawing(s) will be provided by the Office upon request and payment of the necessary fee. For detailed understanding of the present disclosure, references should be made to the following detailed description, taken in conjunction with the accompanying drawings in which like elements have generally been designated with like numerals and wherein.

DETAILED DESCRIPTION

The present disclosure relates to devices and methods for using gamma ray and other sensors on the face and side of a drill bit to obtain measurements relating to the formation in front and side of the drill bit during drilling of a wellbore. The present disclosure is susceptible to embodiments of different forms. The drawings shown and the written specification describe specific embodiments of the present disclosure with the understanding that the present disclosure is to be considered an exemplification of the principles of the disclosure, and is not intended to limit the disclosure to that illustrated and described herein.

Figure 1:
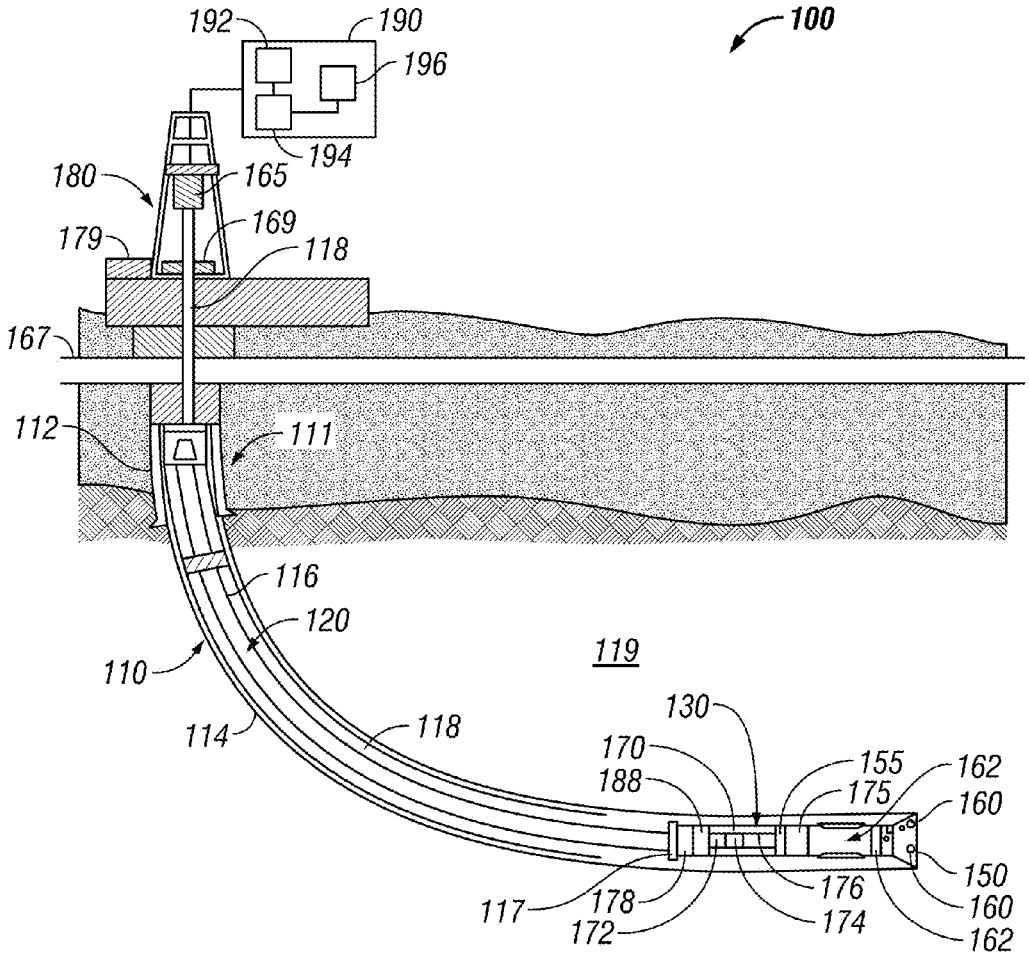
FIG. 1 is a schematic diagram of a drilling system that includes a drill string with a drill bit made according to one embodiment of the disclosure for drilling wellbores.

FIG. 1 is a schematic diagram of an exemplary drilling system 100 that may utilize drill bits disclosed herein for drilling wellbores. FIG. 1 shows a wellbore 110 formed in a formation 119. The wellbore is shown to include an upper section 111 with a casing 112 installed therein and a lower section 114 that is being drilled with a drill string 120. The drill string 120 includes a tubular member 116 that carries a drilling assembly 130 (also referred to as the bottomhole assembly or "BHA") at its bottom end 117. The tubular member 116 may be made up by joining drill pipe sections or it may be coiled tubing. A drill bit 150 is attached to the bottom end of the BHA 130 for disintegrating the rock formation to drill the wellbore 110 of a selected diameter in the formation 119. Not shown are devices such as thrusters, stabilizers, centralizers, and those such as steering units for steering the drilling assembly 130 in a desired direction. The terms wellbore and borehole are used herein as synonyms.

The drill string 120 is shown conveyed into the wellbore 110 from an exemplary rig 180 at the surface 167. The exemplary rig 180 shown in FIG. 1 is a land rig for ease of explanation. The apparatus and methods disclosed herein may also be utilized with rigs used for drilling offshore wellbores. A rotary table 169 or a top drive 165 coupled to the drill string 120 at the surface may be utilized to rotate the drill string 120 and thus the drilling assembly 130 and the drill bit 150 to drill the wellbore 110. A drilling motor 155 (also referred to as "mud motor") may also be provided in the drilling assembly 130 to rotate the drill bit 150. A control unit (or controller) 170, that may be a computer-based unit, may be placed at the surface 167 for receiving and processing data transmitted by the sensors in the drill bit and sensors in the drilling assembly 130 and for controlling selected operations of the various devices and sensors in the drilling assembly 130. The drilling system 100 may further include a surface controller 190 for controlling the drilling assembly 130 and/or processing data received from the drilling assembly. The controller 190, in one embodiment, includes electrical circuits, a processor 192 having access to data and programs 196 stored in a data storage device (or a computer-readable medium) 194. The data storage device 194 may be any suitable device, including, but not limited to, a read-only memory (ROM), a random-access memory (RAM), a flash memory, a magnetic tape, a hard disc and an optical disk. To drill a wellbore, a drilling fluid from a drilling fluid source 179 is pumped under pressure into the tubular member 116. The drilling fluid discharges at the bottom of the drill bit 150 and returns to the surface via the annular space 118 (also referred as the "annulus") between the drill string 120 and the inside wall of the wellbore 110.

Still referring to FIG. 1, the drill bit 150 includes one or more gamma ray sensors proximate the face of the drill bit for detecting naturally-occurring gamma rays in the formation 119 and/or for detecting scattered gamma rays responsive to gamma rays induces into the formation 119 by a suitable source 162 placed in the drill bit 150 or at another suitable location. Naturally occurring gamma rays are gamma rays that are emitted by the rock formation in the absence of induced gamma rays from a radioactive source. Such naturally occurring gamma rays are referred to herein as passive gamma rays and the mode of operation in which passive gamma rays are detected is referred to as the passive mode. When gamma rays are induced into a formation, such as formation 119, by a source such as source 162, the induced gamma rays interact with the formation and scatter. Sensor 160 detects these scattered gamma rays. Scattered gamma rays are referred to as active gamma rays and the mode of operation in which active gamma rays are detected is referred to as the active mode. In one aspect, the source 162 may be selectively activated so that the sensor 160 detects active gamma rays during specific time periods and passive gamma arrays during different time periods. The drilling assembly 130 may further include one or more downhole sensors (also referred to as the measurement-while-drilling (MWD) sensors (collectively designated by numeral 175) and at least one control unit (or controller) 170 for processing data received from the MWD sensors 175 and the drill bit 150. The controller 170, in one embodiment, includes a processor 172, such as a microprocessor, a data storage device 174 and one or more programs 176 for use by the processor 172 to process downhole data and to communicate data with the surface controller 190 via a two-way telemetry unit 188. The telemetry unit 188 may utilize communication uplinks and downlinks. Exemplary communications may include mud pulse telemetry, acoustic telemetry, electromagnetic telemetry, and one or more conductors (not shown) positioned along the drill string 120 (also referred to a wired-pipe). The data conductors may include metallic wires, fiber optical cables, or other suitable data carriers. A power unit 178 provides power to the electrical sensors and circuits in the drill bit and the BHA. In one embodiment, the power unit 178 may include a turbine driven by the drilling fluid and an electrical generator.

The MWD sensors 175 may include sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for making rotary directional surveys. Exemplary sensors may also include sensors for determining parameters of interest relating to the formation, borehole, geophysical characteristics, borehole fluids and boundary conditions. These sensors include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), boundary condition sensors, and sensors for measuring physical and chemical properties of the borehole fluid. Details of the placement of gamma ray sensors in the face and side of the drill bit 150 are described in more detail in reference to FIGS. 2A-8.

Figure 2B:
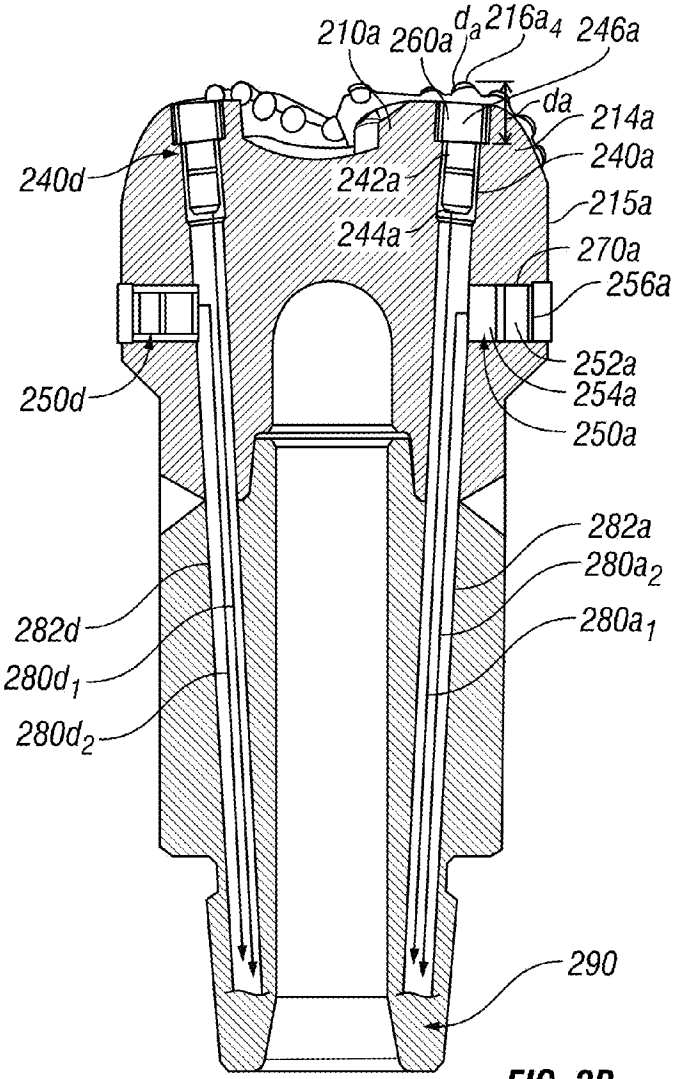
FIG. 2B is a cut-away view of the drill bit of FIG. 2A showing the placement of the gamma ray sensors in the face and side of the blade.
Figure 2A:
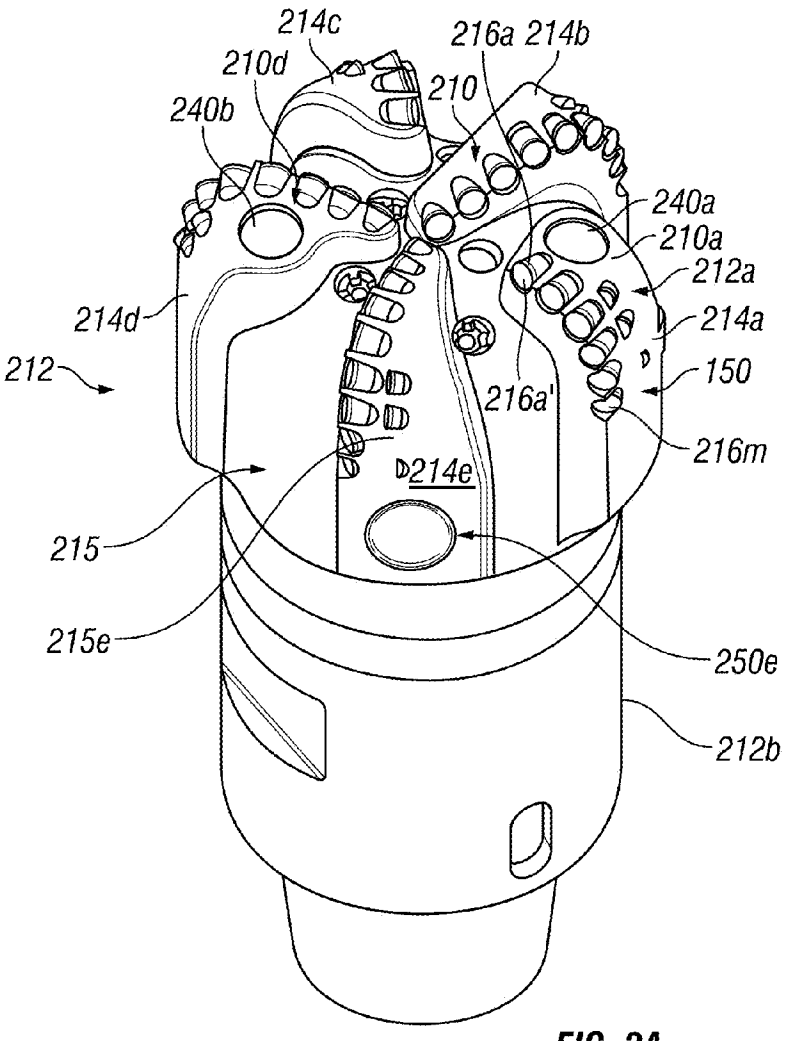
FIG. 2A is an isometric view of an exemplary drill bit showing placement of gamma ray sensors in the face and side of a blade of the drill bit.

FIG. 2A shows an isometric view of an exemplary drill bit 150 that may include one or more gamma ray sensors (generally denoted by numeral 240) on the face 210 of the drill bit 150 and one or more sensors 242 on the side 215 of the drill bit. The drill bit 150 shown in FIG. 2 is a polycrystalline diamond compact ("PDC") drill bit for explanation purposes only. Any other type of drill bit may be utilized for the purpose of this disclosure. The drill bit 150 is shown to include a crown section 212*a* and a shank section 212*b*. The crown section 212*a* includes a number of blade profiles (profiles) 214*a*, 214*b*, . . . 214*n*. A number of cutters are placed along each profile. For example, profile 214*a* is shown to contain cutters 216*a*-216*m*. All profiles are shown to terminate at the face 210 of the drill bit 150. Each cutter has a cutting surface or cutting element, such as element 216*a*' of cutter 216*a*, that engages the rock formation when the drill bit 150 is rotated during drilling of the wellbore.

FIG. 2A shows placement of gamma ray sensors on the face 210 and side 215 of the drill bit 150, according to one embodiment of the disclosure. FIG. 2A shows a gamma ray sensor 240*a* placed on the face 210*a* of blade 214*a* and a gamma ray sensor 240*d* on face 210*d* of blade 214*d*. Also shown is a gamma ray sensor 250*e* on side 215*e* of blade 214*e*. Other sensors may also be placed at suitable locations as described herein. In one aspect, the locations of the sensors 240*a* and 240*d* on the blade surfaces is selected so that such sensors are as close as feasible to the formation when the drill bit 150 is used to drill through the formation without compromising or substantially compromising the overall performance of the drill bit or the health of the sensor as described in more detail in reference to FIGS. 4-8. Sensor 250*e* on the side 215*e* may also be located in a similar manner.

FIG. 2B shows an isometric cut-away section of the drill bit of FIG. 2A showing installation of the gamma ray sensors 240*a*, 240*d* and 250*a* and 250*d* inside the drill bit 150, according to one embodiment of the disclosure. FIG. 2B shows sensor 240*a* placed on the surface 210*a* of blade 214*a* and sensor 250*a* placed on the side 215*a* of blade 214*a*. Once the location of the sensor 240*a* has been determined according to the methods described herein, a cavity 260*a* may be formed through the face 210*a* of blade 214*a* of a size sufficient to house the sensor 240*a* therein. The sensor 240*a*, in one aspect, may include a gamma ray detector 242*a*, such as a sodium iodide crystal, and photomultiplier tube 244*a*, coupled to the sodium iodide crystal 242*a*. The sensor 240*a* is securely placed in the cavity 260*a*. A suitable protection member 246*a* (or window cap) is then placed in front of the sensor 242*a* in the cavity 260*a* to protect the sensor 242*a* from the outside environment. The protection member is formed of a media transparent to gamma radiations. The protection member 246*a* is recessed or offset in the face 210*a*. In one aspect, the protection member 246*a* may be recessed a distance from the first point of contact between the drill bit 150 and the formation. In the particular drill bit 150, the first point of contact is the cutter 216*n*-2. In aspects the recess or offset of 2 mm to 5mm has been determined to be suitable based on the configuration of the drill bit. To place the sensor 250*a* in the side 215*a* of blade 214*a*, a cavity 270*a* is formed. The sensor 250*a* (sodium iodide crystal 252*a* coupled to photomultiplier tube 254*a*) is placed in the cavity 270*a*, which is capped by a protection window 256*a*. The window 256*a* is recessed from the side surface 215*a* of blade 214*a*. Electrical conductors 280*a*1 and 280*a*2 respectively from the sensors 240*a* and 250*a* may be run through bore 282*a* to circuits placed in the neck 290 of the drill bit 150 or in the drilling assembly 130 (FIG. 1) connected to the drill bit 150. Other gamma ray sensors, such as sensors, 240*d*, 250*c* (hidden from the view), 250*d*, etc. may be placed in the drill bit in the manner described above. Conductors 280*d*1 from sensors 240*d* and conductor 280*d*2 from sensor 250*d* are run in bore 282*d*.

Figure 3:
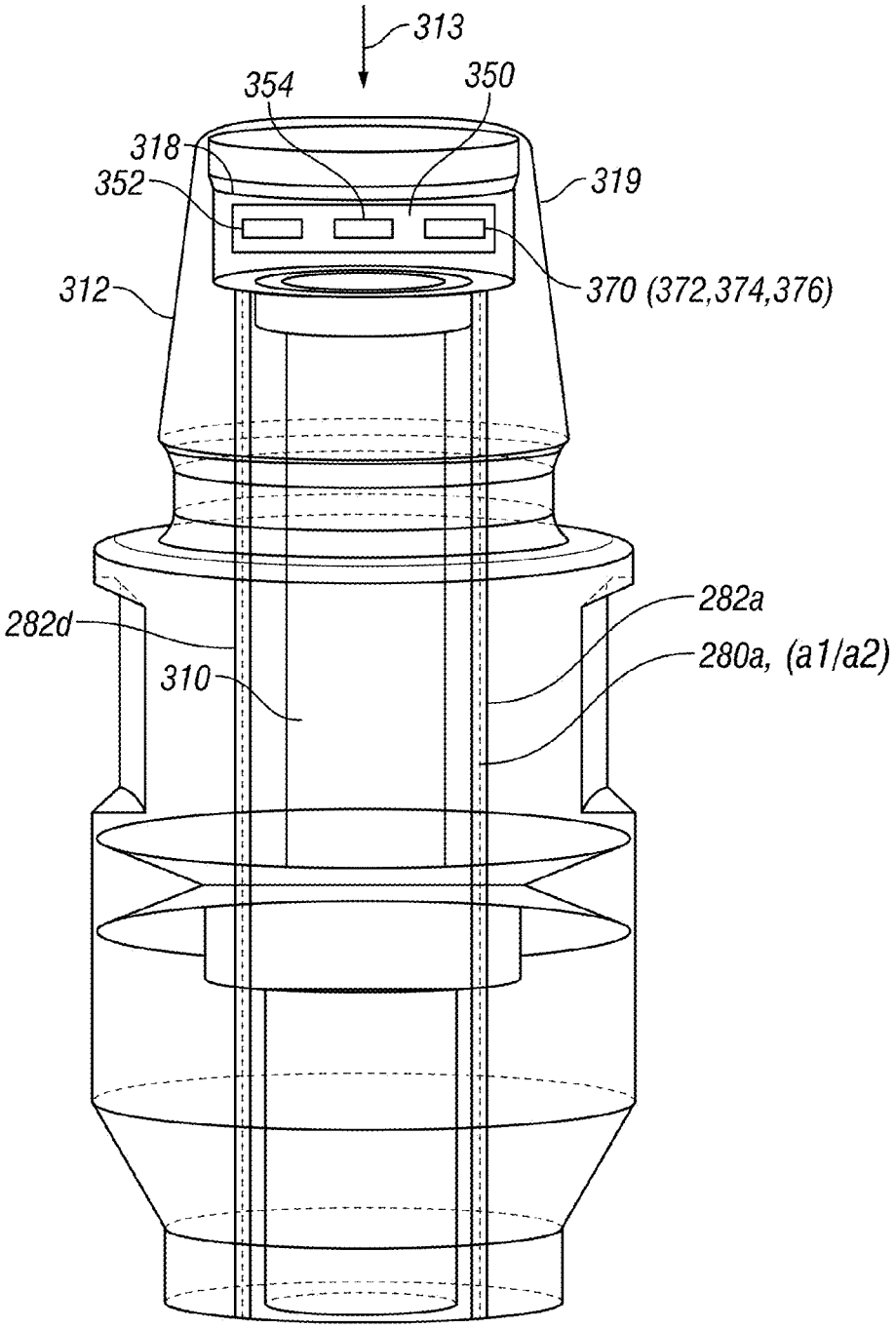
FIG. 3 shows electrical connections between the gamma ray sensors in the drill bit and a control circuitry placed in a neck section of the drill bit shown in FIG. 2A.

FIG. 3 shows certain details of the shank 212*b* according to one embodiment of the disclosure. The shank 212*b* includes a bore 310 for supplying drilling fluid to the crown 212*a* of the drill bit 150 and one or more circular sections surrounding the bore 310, such as a neck section 312, a recessed section 314 and a circular section 316. The upper end of the neck section 312 includes a recessed area 318. Threads 319 on the neck section 312 connect the drill bit 150 to the drilling assembly 130 (FIG. 1). The conductors 280*a*1 from sensor 240*a* and conductors 280*a*2 in the bore 282*a* are run to an electrical circuit 350 in the recessed section 318 in the neck section 312. The circuit 350 may be coupled to the downhole controller 170 (FIG. 1) by communication links that run from the circuit 350 to the controller 170. In one aspect, the circuit 350 may include an amplifier 352 that amplifies the signals from the sensors 240*a* and 250*a* and an analog-to-digital (A/D) converter 354 that digitizes the amplified signals. A processor 370 may be provided for processing of digitized sensor signals. The communication between the drill bit 150 and the controller 170 (FIG. 1) may be provided by direct connections, acoustic telemetry or any other suitable method. Power to the electrical circuit may be provided by a battery or by a power generator in the BHA 130 (FIG. 1) via electrical conductors. In another aspect, the sensor signals may be digitized without prior amplification.

As noted above, the locations of the sensor on the face of the drill bit is selected so that the performance of the drill bit will be transparent to the inclusion of the sensors in the drill bit, i.e., the overall performance of the drill bit will be unaffected or substantially unaffected by the presence of theses sensors in the face of the drill bit. An exemplary method of selecting the locations of the gamma sensors in the face of the drill bit is described for a PDC bit, such as drill bit 150 shown in FIGS. 2A and 2B in reference to FIGS. 4-8. The methods of selecting the location of sensors on the face of a bit described may also be utilized for any other type of drill bit.

Figure 4:
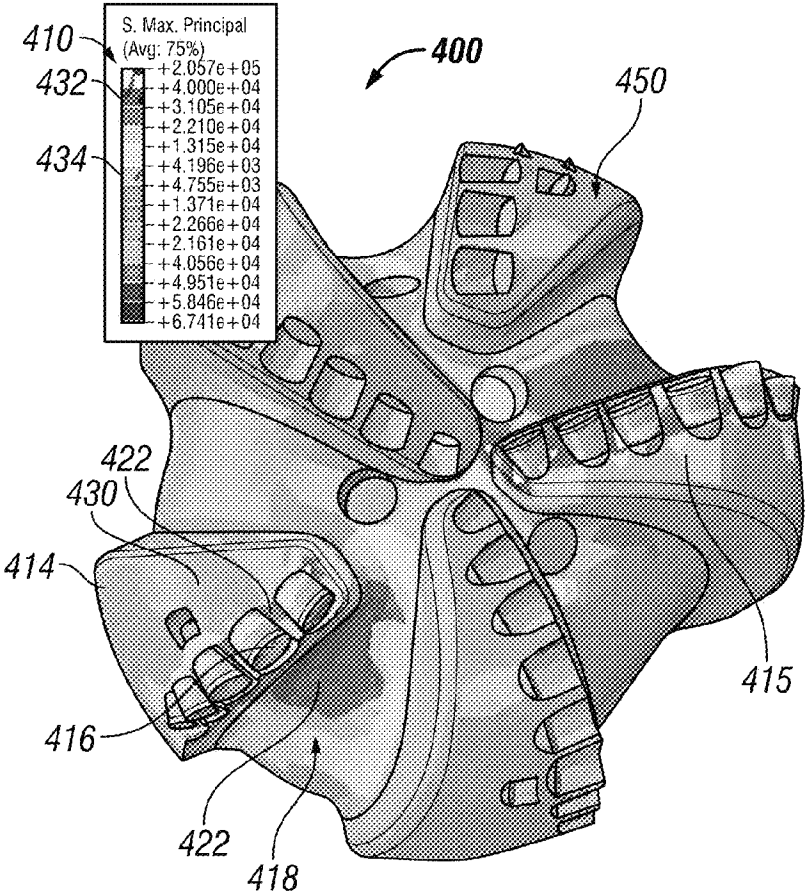
FIG. 4 shows a finite element stress analysis of the drill bit shown in FIG. 2A without any sensors placed therein obtained using a suitable simulation program.

FIG. 4 shows a stress map (or stress analysis) 400 of a PDC drill bit 450, a drill bit similar to the drill bit 150 shown in FIG. 2A, with no sensors placed in the drill bit face. This particular stress map 400 is obtained by performing a finite element analysis using a simulation program. Use of simulation programs to perform finite element analysis is known in the art. Any suitable simulation program may be utilized for the purpose of this disclosure. The numerical stress values for stresses at various locations of the drill bit 450 are shown in table 410. The stress map 400 shows that some of the high stress areas are areas 422 between the cutters on a blade and their adjacent fluid flow channels, such as area 422 between cutters 416 and fluid channel 418. In this particular example, the areas of interest are low stress areas on the face of the blades. FIG. 4 shows that area 430 on the face of blade 414 is under relatively under low stress and is thus may be a suitable place for placement of a sensor, such a gamma ray sensor.

Figure 5:
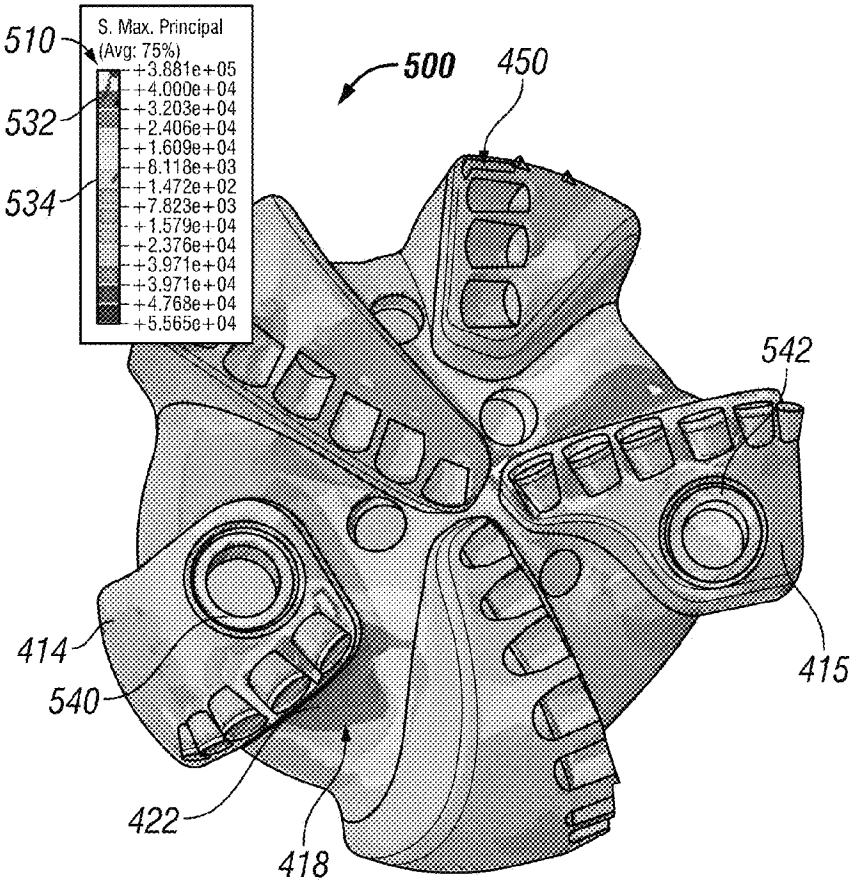
FIG. 5 shows a finite element stress analysis of the drill bit shown in FIG. 4 with sensors placed in the face of the blades of the drill bit.

FIG. 5 shows a stress map 500 of the drill bit 450 shown in FIG. 4 when sensor cavities 540 and 542 are respectively formed on faces of blades 414 and 415. In this particular example, the stress map of FIG. 5 is substantially the same as the stress map 400. After performing stress analyses, such as shown in FIGS. 4 and 5 or by any other suitable method, in one aspect, a fluid flow analysis may be performed to determine the effect of placing sensors on the flow of the drilling fluid through the fluid channels.

Figure 6:
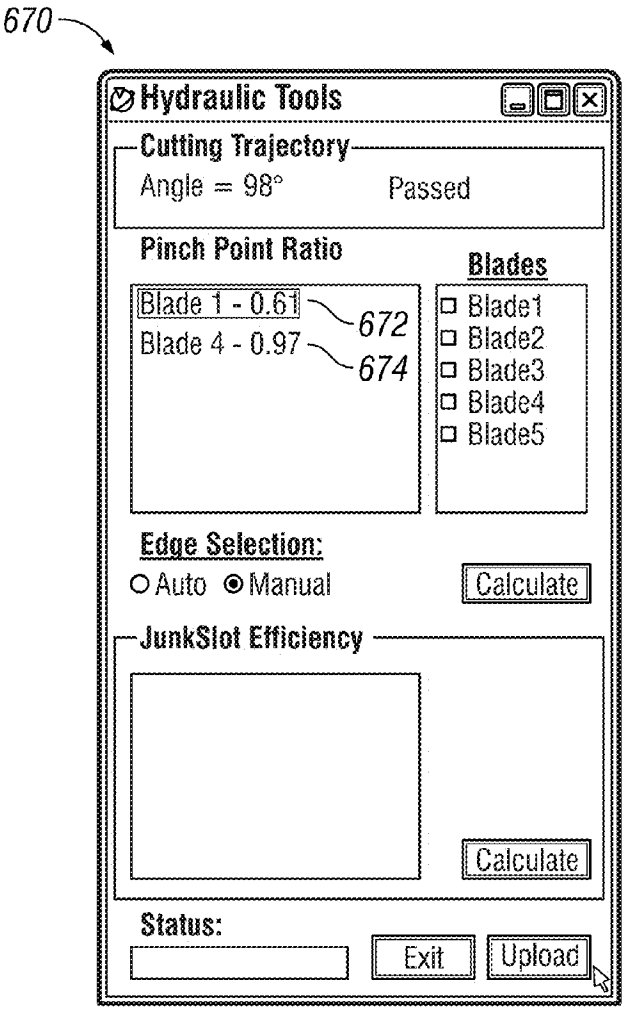
FIG. 6 shows a fluid flow analysis performed on the drill bit shown in FIG. 5, using a suitable simulation model.
Figure 6:
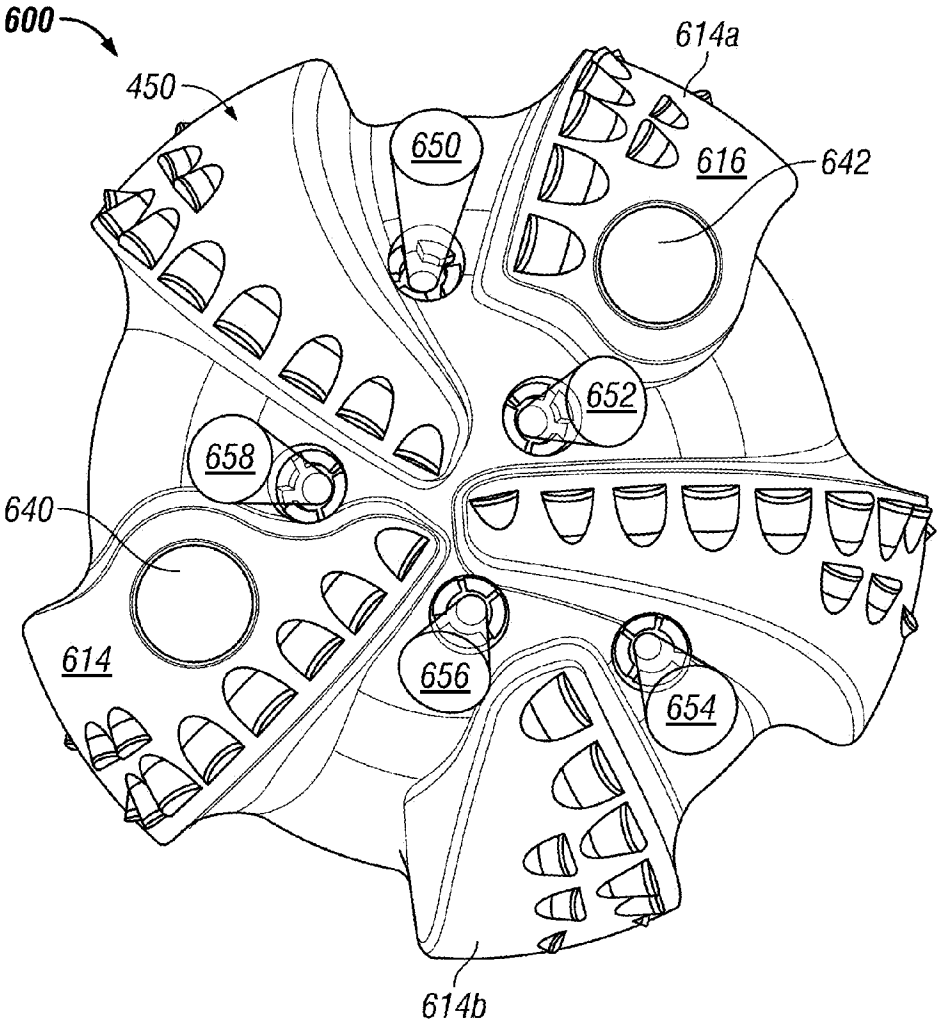

FIG. 6 shows a PDC drill bit 650 of the type shown in FIG. 4 with sensors 640 and 642 respectively placed on surfaces 620 and 622 of bladed blade 614 and 616. FIG. 6 depicts fluid flow behavior for each fluid flow channel 660-668. The fluid cones 670-678 respectively correspond to the fluid flow channels 660-668.

Figure 7:
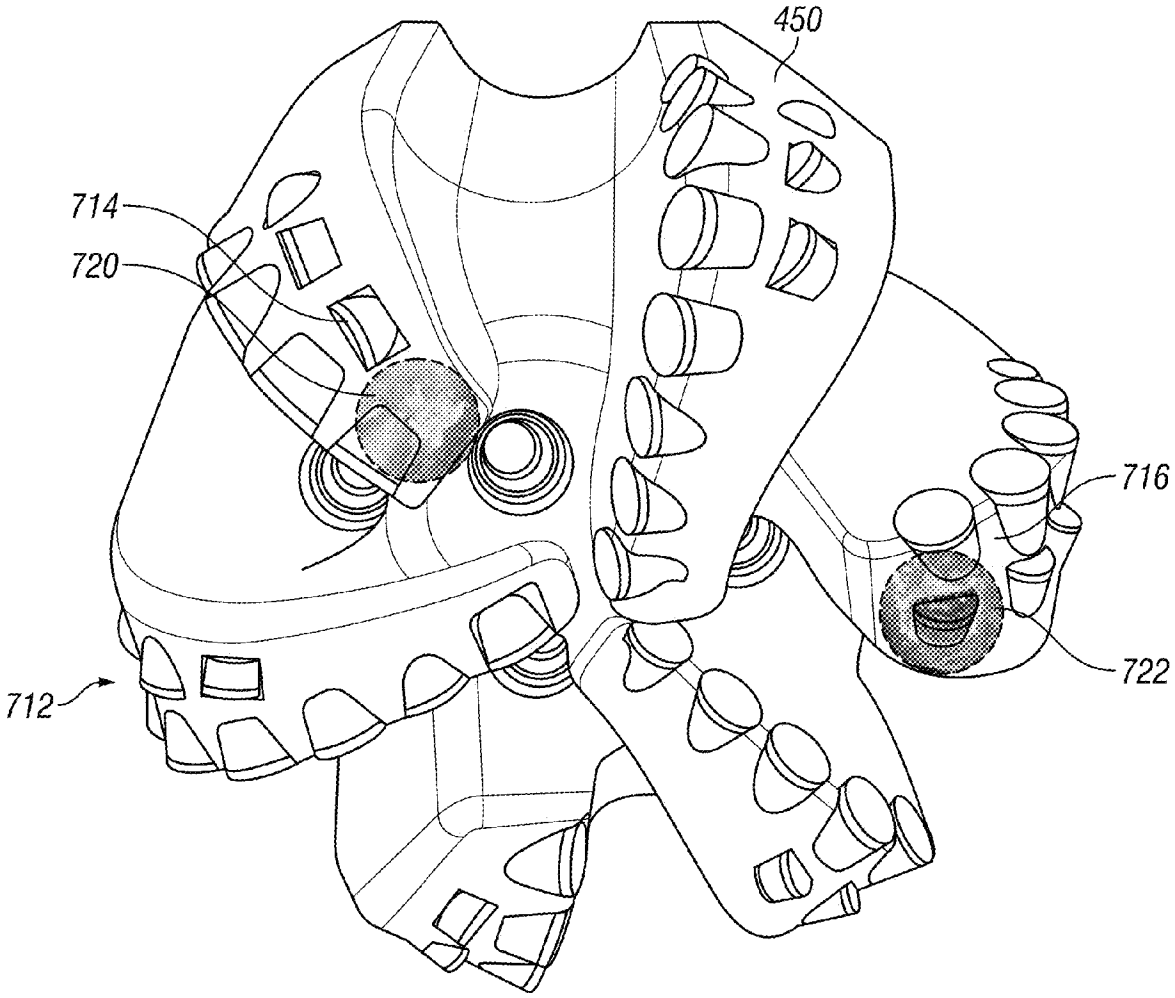
FIG. 7 shows the results of a rubbing test performed in a laboratory on the drill bit shown in FIG. 5.

FIG. 7 shows the results of a rubbing test performed in a laboratory test on a drill bit 750 of the type shown in FIGS. 4-6. For the purpose of this disclosure, a "rubbing" test means a test performed on a drill bit to determine the extent to which one or more surfaces of a drill bit erode due rubbing of such surfaces against a rock formation. Any suitable test may be performed to determine the rubbing effect for the purpose of this disclosure. For the particular rubbing test shown in FIG. 7, the cone section of the drill bit 750 was painted with a durable paint. The drill bit was then used to drill through a rock formation (similar to a rock expected to be encountered during drilling of a wellbore) in a laboratory. FIG. 7 shows the results of such a test. In particular, FIG. 7 shows that surfaces 720 and 722 of faces of blades 714 and 716 retained paint thereon, indicating relatively low or no rubbing effect. These locations are the same as sensor locations shown in FIGS. 5 and 6. Thus, areas 720 and 722 are suitable places for installing sensors.

Figure 8:
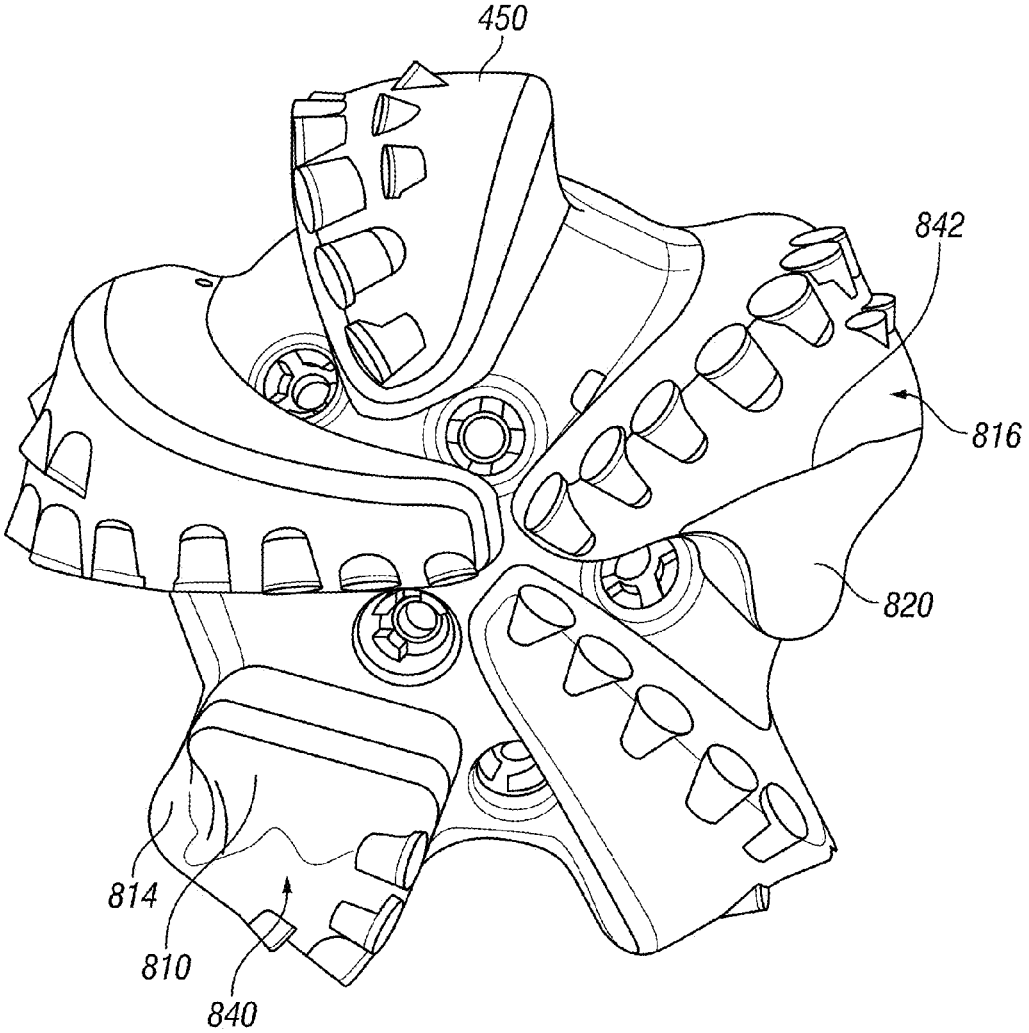
FIG. 8 shows a drill bit used for performing rubbing and balling tests on a drill bit of the type shown in FIG. 5.

FIG. 8 shows results 800 of a rubbing and balling test performed on drill bit 850 in a laboratory test. To perform such a test, an epoxy material 810 was placed on location 840 on a face surface of blade 814 and an epoxy material 820 was placed on location 842 of a face surface of blade 816. The drill bit was then used to drill through a rock formation, similar to test performed relating to FIG. 7. FIG. 8 shows that much of the epoxy remains on the surfaces 840 and 842, indicating relatively little rubbing effect. This test further confirms that the selected location 840 and 842 are suitable for installing sensors, such as gamma ray sensors, pressure, sensors, temperature sensors, acoustic transducers and other suitable sensors.

In one aspect, after the sensor locations have been determined as described above, the above-noted process or method may be iterated one or more times. Multiple iterations may be performed to obtain an optimized or substantially optimized drill bit design with the sensors. In other aspects, once the locations of the sensors have been determined and one or more sensors are placed on an actual drill bit, the drill bit with such sensors may be tested to confirm the viability of the sensor locations chosen and the drill bit integrity. The sensor locations so selected can provide improved fidelity (accuracy) of measurements of the formation and environment effects (e.g. gamma ray measurements, formation temperature, formation pressure, etc.) during drilling of wellbores Thus, in one aspect, sensor locations on a surface of drill bit may be determined using results of one or more of stress modeling or simulation analyses, one or more rubbing tests, one or more fluid flow tests and one or more balling tests. Other tests also may be performed to either select the sensor locations on the surfaces of the drill bit or to confirm the locations already selected.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. A method of making a drill bit, comprising:
selecting a drill bit configuration;
obtaining a stress map for the selected drill bit configuration relating to a drilling operation;
performing a mechanical stress test on the drill bit having the selected configuration; and
selecting a location on a surface of the drill bit having the selected configuration at which the stress map data and results of the mechanical stress test indicate an area of low stress; and
placing a sensor at the selected location.

2. The method of claim 1, wherein obtaining the stress map comprises performing a finite element analysis on the drill bit having the selected configuration without a sensor thereon.

3. The method of claim 1, wherein obtaining the stress map comprises performing a finite element analysis on the drill bit having the sensor thereon.

4. The method of claim 1, wherein the mechanical stress test is selected from a group consisting of a: fluid flow test; rubbing test; and balling test.

5. The method of claim 1, wherein the selected location is at a face of the drill bit and corresponds to a location showing less stress on the stress map than stress on another location on the face of the drill bit.

6. The method of claim 1, wherein the drill bit is selected from a group consisting of a: PDC bit; diamond cutting bit; and roller cone bit.

7. The method of claim 1, wherein the mechanical stress test is a rubbing test that includes:
coating a face of the drill bit having the selected configuration with a selected material; and
using the drill bit with the coated surface to drill into a solid material.

8. The method of claim 1, wherein the mechanical stress test is a balling test that includes:
placing a selected material on a selected location on the drill bit;
drilling with the drill bit with the selected material placed thereon into a solid material; and
determining an amount of balling of the selected material based on the drilling into the solid material.

9. The method of claim 1, wherein the sensor is selected from a group consisting of: a gamma ray sensor; an acoustic sensor; a resistivity sensor; a nuclear sensor; a pressure sensor; a temperature sensor; an accelerometer; and a vibration sensor.

10. A drill bit, comprising:
a sensor at a selected location of low stress on a surface of the drill bit, wherein the selected location has been obtained by:
obtaining a stress map for a selected drill bit configuration relating to a drilling operation;
performing a mechanical stress test on a drill bit having the selected configuration; and
selecting the selected location on a surface of the drill bit having the selected configuration at which the stress map data and results of the mechanical stress test indicate an area of low stress.

11. The drill bit of claim 10, wherein the sensor is placed in a cavity on the face of the drill bit.

12. The drill bit of claim 10 further comprising a protective member on the sensor configured to protect the sensor from coming in contact with a formation during drilling of a wellbore with the drill bit.

13. The drill bit of claim 10, wherein the mechanical stress test is selected from a group consisting of: a fluid flow test; a balling test; and a rubbing test.

14. The drill bit of claim 10 further comprising an electronic circuit in the drill bit configured to process signals from the sensor.

15. The drill bit of claim 14, wherein the electronic circuit includes a processor configured to provide information about a parameter of a formation proximate the drill bit during a drilling of the formation by the drill bit.

16. The drill bit of claim 13, wherein the drill bit is selected from a group consisting of a: PDC bit; diamond cutting bit; and roller cone bit.

17. The drill bit of claim 10, wherein stress map is obtained by performing a finite element analysis on the drill bit having the selected configuration as one of: with a sensor in the drill bit; and without the sensor in the drill bit.

18. The drill bit of claim 10, wherein the mechanical stress test is a rubbing test that includes:
coating a face of the drill bit having the selected configuration with a selected material; and
using the drill bit with the coated material to drill into a solid material.

19. The drill bit of claim 10, wherein the mechanical stress test is a balling test that includes:
placing a selected material on the selected location;
drilling with the drill bit with the selected material placed thereon into a solid material; and
determining an amount of balling of the selected material based on the drilling into the solid material.

20. A drilling apparatus, comprising:
a drilling assembly;
at least one sensor in the drilling assembly configured to provide information about one of the drilling assembly and a formation surrounding the drilling assembly during a drilling operation;

a drill bit at an end of the drilling assembly; and a sensor placed at a selected location of low stress on a surface of the drill bit, wherein the selected location has been obtained by:

obtaining a stress map of a drill bit of the selected configuration relating to drilling by a drill bit of the selected configuration into a solid material;

performing a mechanical stress test on the drill bit having the selected configuration; and determining the selected location on the drill bit surface at which the stress map and results of the mechanical stress test indicate an area of low stress.

21. The drilling apparatus of claim 20 further comprising a controller configured to process signals received from the sensor in the drill bit during a drilling operation to determine a downhole parameter.

22. The drilling apparatus of claim 20, wherein the sensor in the drill bit is selected from a group consisting of: a gamma ray sensor; an acoustic sensor; a resistivity sensor; a nuclear sensor; a pressure sensor; a temperature sensor; an accelerometer; and a vibration sensor.

23. The method of claim 1 further comprising repeating one or more of the performing the mechanical stress test and selecting the location of a new location of the surface of the drill bit.

* * * * *